United States Patent [19]

Jameson

[11] Patent Number: 4,586,567

[45] Date of Patent: May 6, 1986

[54] SUBTERRANEAN WELL TOOL WITH PRESSURE-EQUALIZING RELEASE

[75] Inventor: Robert C. Jameson, Houston, Tex.

[73] Assignee: Baker Oil Tools, Inc., Orange, Calif.

[21] Appl. No.: 631,464

[22] Filed: Jul. 16, 1984

[51] Int. Cl.[4] ..... E21B 33/126; E21B 33/129; E21B 34/08

[52] U.S. Cl. ..... 166/121; 166/129; 166/133; 166/322

[58] Field of Search ..... 166/212, 120, 133, 121, 166/128, 186, 332, 322, 334, 134, 126, 131, 130, 202, 138, 140, 127, 129

[56] References Cited

U.S. PATENT DOCUMENTS 3,122,205 2/1964 Brown et al. ..... 166/2.2 X
3,266,576 8/1966 Chenoweth ..... 166/131 X
3,460,616 8/1969 Tucker et al. ..... 166/120
3,526,277 9/1970 Scott ..... 166/127 X
4,460,041 7/1984 Berryman ..... 166/134

*Primary Examiner*—Stephen J. Novosad
*Assistant Examiner*—David J. Bagnell
*Attorney, Agent, or Firm*—Norvell & Associates

[57] ABSTRACT

A retrievable well tool for use in a subterranean well conduit utilizes plural valving elements to establish a fluid bypass around at least one annular elastomeric sealing element in response to movement of a control mandrel. The annular elastomeric sealing element actuates slips carried on the tool to engage the conduit wall in response to a differential pressure across the sealing element. The fluid bypass established by movement of the control mandrel is accomplished prior to an effective disengaging movement being imparted to the actuated slip elements.

10 Claims, 7 Drawing Figures

SUBTERRANEAN WELL TOOL WITH PRESSURE-EQUALIZING RELEASE

BACKGROUND OF THE INVENTION

1. Field of the Invention

This invention relates to a subterranean well tool, such as a bridge plug, for temporary installation in an oil well conduit, of the type having an elastomeric seal element producing relative movement between cooperating cone and slip elements to sealingly lock the bridge plug in the conduit, wherein pressure-equalization across the elastromeric seal element is effected prior to releasing the slip elements from engagement with the conduit.

2. Description of the Prior Art

Bridge plugs have been employed in subterranean wells for many years. The primary purpose of a bridge plug is to provide a temporary anchoring of a tool at a desired location in a well conduit, accompanied by a sealing of the annular space between the tool and the internal wall of the well conduit. Bridge plugs in commercial use, such as the Model C Retrievable Bridge Plug sold by BAKER SERVICE TOOLS of Houston, Tex., typically utilize a hollow tubular body on which two axially spaced sets of cone elements are secured. Intermediate the cone elements, a pair of axially spaced sets of slip elements are mounted on a cross-link which is supported in diametrically opposed slots in the tubular body so that relative movement of the tubular body with respect to the slip elements in either direction will produce an outward camming of one set of slips into engagement with the conduit wall, but not the other set of slips. Such relative movement is produced by one of a pair of annular elastromeric sealing elements, sometimes referred to as packer cups, which are respectively mounted on the tubular body adjacent the cone elements. One packer cup is responsive to a downward fluid pressure differential to move the tubular body downward, while the other is responsive to an upward fluid pressure differential to move the tubular body upwardly. Thus, when such a conventional bridge plug is positioned at a desired location in the well conduit, the existence of an upwardly or downwardly directed fluid pressure differential across the packer cups will determine whether the lowermost cone moves upwardly to engage the adjacent set of slips or the uppermost set of cones moves downwardly to engage the adjacent set of slips. In either event, only one set of slips is cammed outwardly into engagement with the conduit wall in response to the existing fluid pressure differential.

The tubular body is carried into the well by a mandrel inserted therethrough which is provided with an appropriate slot to accommodate the cross-link. A running-in tool engages the upper end of the mandrel and the upper end of the tubular body to maintain these elements in a desired axial relationship during the running in of the tools. An annular fluid passage is defined between the exterior of the mandrel and the interior of the tubular body and such passages are closed at each end by a spring pressed annular piston valve. A downwardly facing abutment shoulder on the mandrel is engagable with the lowermost piston valve to shift such valve to an open position by downward movement of the mandrel as the first step in releasing the bridge plug from the conduit. The opening of the lower piston valve produces an equalization of pressure across the lowermost elastromeric sealing element so that the slip element associated with the lowermost cone may be moved upwardly off the cone surface by upward movement of the tubular body member. Such upward movement of the tubular body member is produced by a shoulder provided on the mandrel which engages the uppermost valve and moves it to an open position and then into abutting relationship with a shoulder on the tubular body to initiate the upward movement of the tubular body. Thus, with both valves having been successively opened, it was presumed that pressure balancing across the two elastomeric seal elements would be achieved.

In the practical utilization of this type of valve, some difficulties have been encountered. For example, the initial downward movement of the mandrel required to open the lower piston valve to achieve equalization of pressure across the lower elastomeric sealing element is often accomplished by the operator very rapidly, so the pressure differential across the lower elastomeric sealing element is not completely neutralized. As the mandrel is moved upwardly, any residual pressure differential or pressured well fluids will cause the lower cone to remain in engagement with the lower set of slips and effect the anchoring of the tubular body to the conduit wall, thereby preventing withdrawal of the tool without incurring serious damage to the conduit wall and/or the slips. Also, as the tool is raised upwardly through the well conduit, it may pass through production zones where well fluids are flowing into the conduit, thus providing a fluid pressure differential across the lower elastromeric sealing element with the same adverse results as heretofore mentioned.

In an effort to overcome these difficulties, another type of tool has been developed which is disclosed in co-pending application Ser. No. 417,012, filed Sept. 13, 1982, now U.S. Pat. No. 4,460,041 and assigned to the Assignee of this application. This tool employs a bypass fluid passage within the control mandrel. Three sleeve-type sliding valves are then provided to cooperate with the control mandrel so the downward movement of the control mandrel establishes a bypass fluid passage around the lowermost one of the annular elastomeric sealing elements and upward movement of the mandrel establishes a permanent fluid bypass around both annular sealing elements which remain in effect after the control mandrel engages the body of the tool to withdraw same from the well conduit. The provision of the fluid bypass within the interior of the control mandrel might have a tendency to weaken the physical strength of this element and, of course, might make the control mandrel somewhat more expensive to manufacture. Additionally, the flow area available for the bypass passage is somewhat restricted and, obviously, as large as possible bypass flow area is desired in order to assure complete neutralization of any fluid pressure differential across either of the annular elastomeric sealing elements as either upward or downward movement of the tubular body carrying such elements is effected by the control mandrel.

SUMMARY OF THE INVENTION

In accordance with this invention, an essentially solid control mandrel is provided which is devoid of any internal fluid passage. The mandrel is, of course, provided with a traversing slot to mount the conventional cross-link upon which the two sets of axially spaced slip elements are mounted in conventional fashion.

The control mandrel is inserted within a tubular body which is also transversely slotted to accommodate the slip mounting cross-link. Additionally, the tubular body rigidly mounts a pair of annular unidirectional elastomeric sealing elements which are disposed adjacent to cone elements by which the acutation of one or the other set of slips is secured respectively by upward or downward movement of the tubular body with respect to the slip elements. As is conventional in these mechanisms, when the bridge plug is lowered by the control mandrel to a desired position within the well conduit, the existence of downward fluid pressure differential across the uppermost unidirectional elastomeric sealing element will effect the sealing engagement of such sealing element with the conduit wall, and producing relative movement of the tubular body with respect to the bridge-carried slips to achieve engagement with the lower actuating cone carried on the tubular body and the expansion of the lowermost slip into engagement with the conduit wall to prevent further displacement of the tool in response to the downwardly directed fluid pressure differential. In like manner, if an upward fluid pressure differential exists across the annular elastomeric sealing elements, the lowermost annular elastomeric sealing element will be expanded into sealing engagement with the conduit wall and produce a relative movement of the bridge-carried slips with respect to the upper cone element to actuate the upper slip into biting engagement with the conduit wall, thus anchoring the bridge plug against the upwardly directed fluid pressure.

To effect the release of the slips from engagement with the conduit wall in order to permit movement of the bridge plug in the conduit, or to retrieve same, it is obviously necessary that the fluid pressure differential existing across both sets of elastomeric sealing elements must be neutralized. To effect such neutralization, this invention provides an annular fluid bypass passage defined between the exterior of the control mandrel and the interior bore of the tubular body. An upper radial port is provided in the tubular body at a position above the uppermost elastomeric sealing element and a pair of axially spaced radial ports are provided in the portion of the tubular body below the lowermost annular elastomeric sealing elements. All of such ports are in communication with the annular fluid bypass passage, but the ports are normally closed by poppet or sliding sleeve-type, or similar valves, which may be spring urged to a closed position with respect to the ports.

The control mandrel is provided with an abutment shoulder to actuate the lowermost valve to an open position by movement of the control mandrel relative to the tubular body. Such movement thus opens the fluid bypass passage around the lowermost annular elastomeric sealing element which is normally the element that is sealingly engaged with the well conduit.

The intermediate valve is mounted on the internal bore surface of the tubular body and is movable upwardly by a spoke-like abutment member secured to the control mandrel, thus opening the fluid bypass passage to the fluid pressure existing below the lowermost annular elastomeric sealing element in response to movement of the control mandrel relative to the tubular body.

The uppermost port is sealed by a valve which is mounted in surrounding relationship to the control mandrel and is movable by an abutment shoulder formed on the control mandrel. Thus, both the uppermost and intermediate valves are moved to an open position by movement of the control mandrel, thus opening the fluid bypass passage to equalize fluid pressure above and below both annular elastomeric sealing elements. Further movement of the control mandrel brings the uppermost valve into abutting engagement with a shoulder on the tubular body and initiates movement of the tubular body to displace the entire tool. Such displacement can occur very readily since no fluid pressure differential can exist across either of the elastomeric sealing elements during such upward movement.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENTS

Figure 1A:
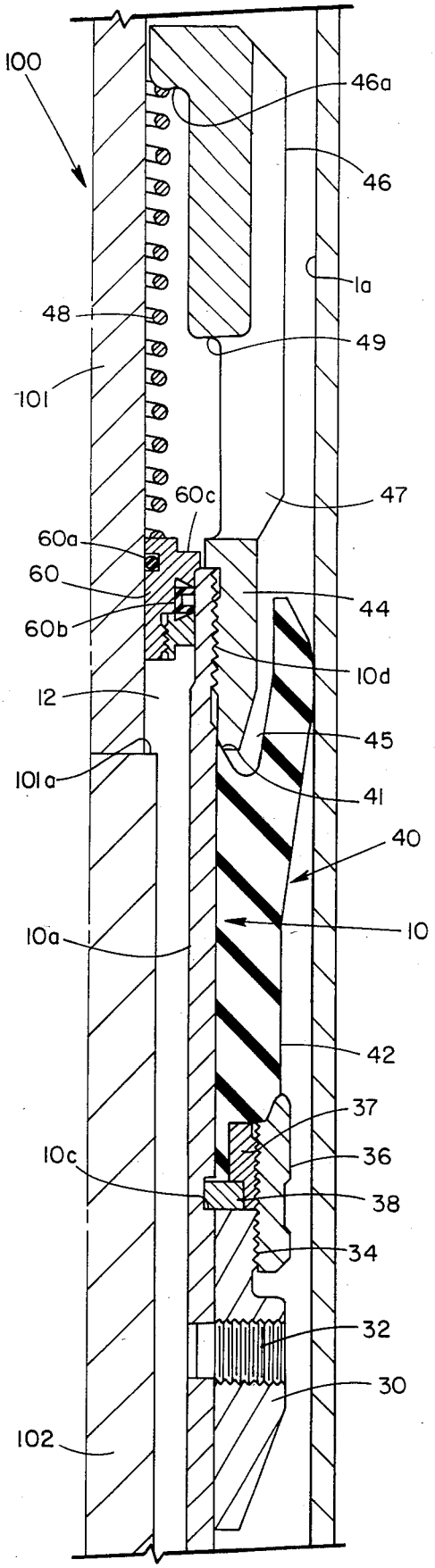
FIGS. 1A, 1B, 1C, 1D, and 1E collectively represent a vertical quarter sectional view of a bridge plug incorporating the pressure-equalizing valving construction embodying this invention.
Figure 1B:
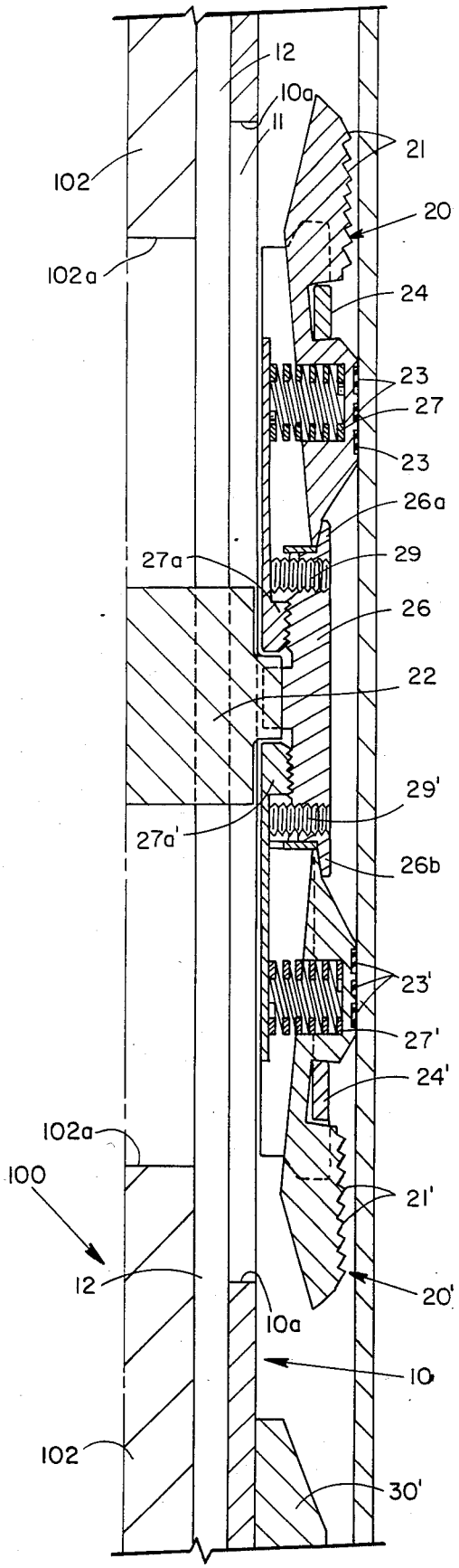
Figure 1E:
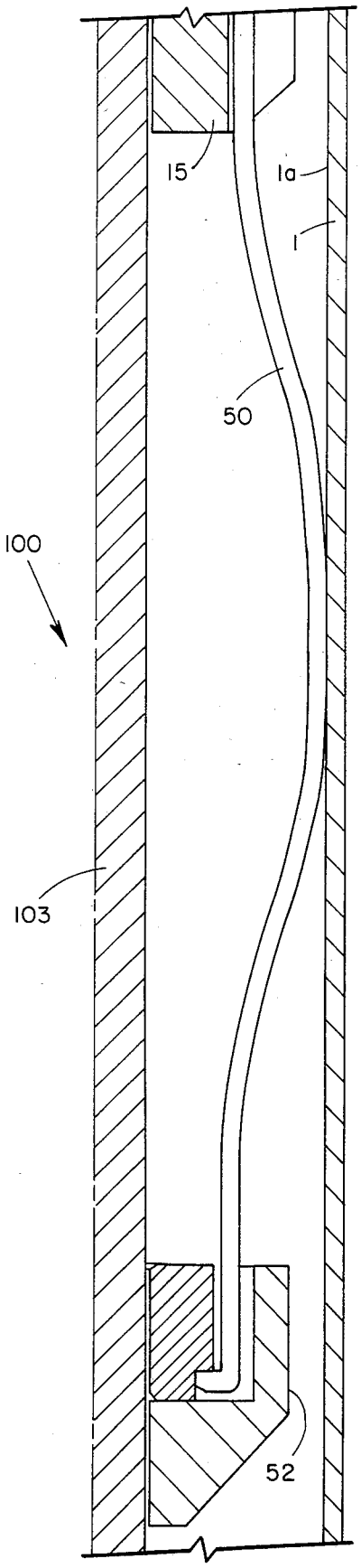

Referring to the drawings, a well tool, such as a bridge plug, involving the pressure-equalizing feature of this invention, is shown as comprising a tubular body assembly 10 on which are mounted in conventional fashion expandable upper and lower slip elements 20 and 20', which are respectively expanded into engagement with the inner wall 1*a* of the well conduit 1 by axially spaced cone elements 30 and 30'. Above the upper cone element 30 a conventional unidirectional packer cup 40, comprising an annular elastomeric sealing element that is unidirectionally responsive to downward fluid pressure, is secured to the tubular body 10, and below the lower cone element 30' a similar packer element 40' which is unidirectionally responsive to upwardly directed pressure differential is secured to the tubular body 10. Lastly, a conventional drag spring 50 is secured to the lower portions of tubular body assembly 10 and terminates in an annular drag ring head 52 which freely surrounds the lower end 103 of a control bar or mandrel 100.

The control bar or mandrel 100 is a rod-like element having an upper rod portion 101, an intermediate enlarged, portion 102 and a lower rod portion 103. A control bar head 104 (FIG. 2) is secured to its upper end and provides a radially projecting pin 95 for cooperation with a conventional wireline or tubing-carried J-slot actuating sleeve (not shown). Mandrel 100 defines a large area annular bypass passage 12 between its external surface and the bore 10*a* of tubular body 10. Bypass passage 12 extends from the above seal 40 to a region well below seal 40'.

Referring now specifically to FIGS. 1A–1E, the slip units 20 and 20' constitute conventional rocker-type units employed in the Baker Model C Retrievable Bridge Plug sold by BAKER SERVICE TOOLS of Houston, Tex. Such slip elements will not, therefore, be described in detail but it should be noted that the conduit engaging teeth 21 of the upper slip unit 20 are shaped so as to prevent downward movement of that slip element relative to the conduit while the teeth 21 of the lower slip unit 20' are shaped to prevent upward movement of that slip element when engaged with the conduit wall 1*a*. Both sets of slip elements 20 and 20' are mounted on the radially outer ends of a conventional cross-link 22 which in turn is disposed within an elongated slot 10*a* formed in the tubular body 10 and a slot 102*a* formed in the central portion 102 of mandrel 100. Slip units 20 and 20' are therefore free to move axially relative to both the tubular body 10 and the mandrel 100 through a limited distance.

Slips 20 and 20' are normally held in a retracted position through the action of compression springs 27 and 27' which rock the non-serrated ends of the slip elements 20 and 20' around retaining bands 24 and 24'. The non-serrated ends of slip elements 20 and 20' are respectively provided with pads 23 and 23' to frictionally engage the conduit wall 1*a* as the tool is inserted in the well conduit 1. A ring element 26 has its opposite axial ends 26*a* and 26*b* respectively cooperable with the adjacent ends of slip elements 20 and 20'. Ring element 26 is threadably secured to spring seat sleeves 27*a* and 27*a'*.

The actuating cones 30 and 30' of the slip elements 20 and 20', respectively constitute conventional cone-shaped annular members which are rigidly secured to the periphery of the tubular body 10 by set screws 32 and 32'. The upper end of the cone 30 is provided with external threads 34 on which a packing element retaining ring 36 is engaged. A split ring 38 underlies the packing element retaining ring 36 and cooperates with an annular groove 10*b* provided in the external wall of the tubular body 10 to further anchor cone 30. An externally threaded ring 37 underlies ring 36 and is bonded to the packing element 40.

The annular elastomeric packing element 40 is of conventional configuration and has a reduced-diameter end 42 bonded to the retaining ring 37. At the other end of the packing element 40, an upwardly open, internal recess 45 is defined within which a second packing element retaining ring portion 44 fits and overlies an upwardly projecting portion 41 of packing element 40. The second packing element retaining ring portion 40 is threadably secured to external theads 10*d* provided on the upper end of the tubular body 10.

The second packing element retaining ring portion 44 constitutes an integral lower portion of an upper valve cage element 46 which terminates at its upper end with an internally projecting flange 46*a*, providing a mounting for the upper end of a compressible valve spring 48. The other end of spring 48 seats against the upper surface of a poppet or sliding sleeve-type valve 60, hereinafter called the top bypass piston valve, which normally seals the bypass annulus 12 defined between the interior bore 10*a* of the tubular body 10 and the exterior of the mandrel 100. The seal elements 60*a* and 60*b* on the valve 60 respectively cooperate with the external surface of upper rod portion 101 of mandrel 100 and the internal surface of tubular body 10. One or more fluid passages or ports 47 are provided in valve cage 46.

An external shoulder 101*a* formed between the rod portion 101 of mandrel 100 and the enlarged diameter central portion 102 is normally positioned some distance below the lower face of the annular piston valve 60. As the mandrel 100 is raised with respect to the tubular body 10, the shoulder 101*a* engages the bottom face of the piston valve 60 and moves such valve upwardly to an open position, compressing spring 48, until the top face 60*c* of the piston valve 60 engages a downwardly facing surface 49 defined on the valve cage 46. Further upward movement of mandrel 100 will then produce a corresponding upward movement of the tubular body 10.

The lower cone element 30' is identical in construction to the previously described upper cone element 30 and is secured to the exterior of the tubular body 10 by set screws 32'. The lower end of the lower cone unit 30' is provided with a threaded section 34' to which is secured a first packing cup retaining ring 36', which overlies the upper end 42' of the lower packing cup 40' and a retaining ring 37' in the same manner as heretofore described in connection with the upper packing cup 40. A C-ring 38' further anchors the assembly to the tubular body 10. The lower projecting portion 41' of the lower packing cup 40' is secured in position by an overlying end portion of a body extension sleeve 13 which is threadably engaged to external threads 10*e* providing on the lower end of the tubular body 10.

The sleeve 13 constitutes, in effect, an extension of the tubular body 10 and defines at its bottom end reduced-diameter external threads 13*a* which engage internal threads at the top end of an intermediate port sleeve 14. Sleeve 14 defines at its bottom end external threads 14*a* which engage internal threads 16*a* at the top of a lower port sleeve 16. The bottom end of lower port sleeve 16 defines a conventional anchor portion 15 for the upper end of the drag spring 50. A retaining ring 19 surrounds anchor portion 15 and is retained in position by set screw 19*a*.

It will be noted that the annular bypass fluid passage 12 extends downwardly past both of the elastomeric sealing elements 40 and 40' and, in fact, communicates with the interior bore of the lower port sleeve 16.

Figure 1C:
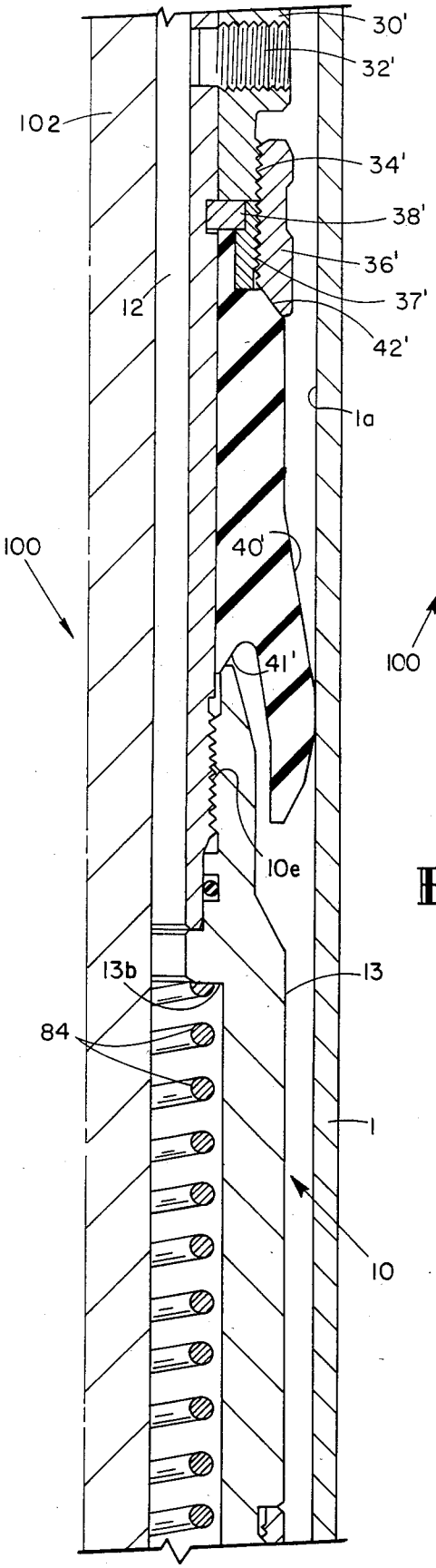
Figure 1D:
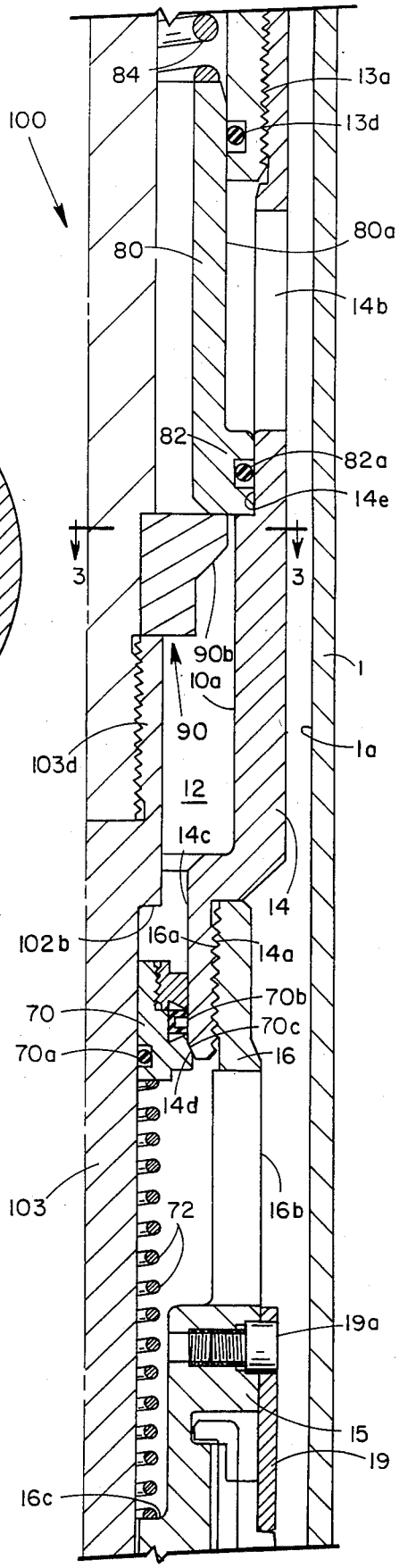

One or more peripherally spaced radial ports 16*b* are provided in the lower port sleeve 16 and similarly, one or more peripherally spaced radial ports 14*b* are provided in the intermediate port sleeve 14. As shown, a poppet valve 70 is provided in the fluid passage 12 to effect the isolation of the ports 16*b*. Poppet valve 70 has an internal O-ring 70*a* sealingly engaged with the exterior of lower rod portion 103 of the mandrel 100. An external sliding seal 70*b* cooperates with a seal bore surface 14*c* provided internally of the intermediate port sleeve 14. A spring 72 urges the poppet valve 70 to its normal closed position, as shown in FIG. 1D, wherein an upwardly facing angular surface 70*c* provided on the valve engages a similarly sloped end surface 14*d* provided on the bottom end of the body extension sleeve 14. The other end of spring 72 bears against an internal shoulder 16*c* provided on the lower portion of the lower port sleeve 16.

Figure 2:
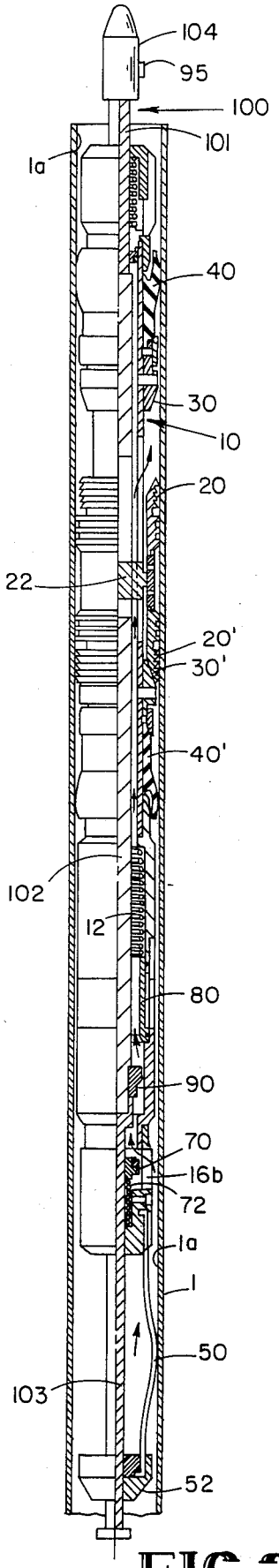
FIG. 2 is a reduced-scale quarter sectional view of the bridge plug shown in FIGS. 1A–1E, but illustrating the position of the valving elements when the mandrel is moved downwardly to initiate releasing movement of the tool.
Figure 3:
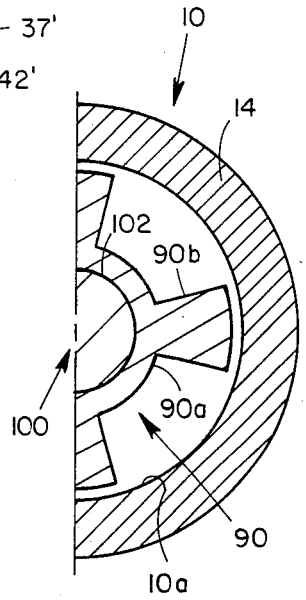
FIG. 3 is a sectional view taken on the plane 3—3 of FIG. 1D.

Since the lower mandrel rod portion 103 is of smaller diameter than the intermediate portion 102 of the mandrel 100, a shoulder 102*b* is formed at such junction and this downwardly facing shoulder is engagable with the poppet valve 70 to move it downwardly with the mandrel and thus open fluid communication between the ports 16*b* and bypass fluid passage 12, as shown in FIG. 2.

The ports 14*b* in the intermediate port sleeve 14 are normally sealed by a sliding sleeve valve 80 which is mounted on the interior of the tubular body extension sleeve 13 and the intermediate port sleeve 14. Thus, the sliding sleeve valve 80 is provided with a radially enlarged bottom portion 82 within which an external O-ring 82*a* is mounted which sealingly engages an internal surface 14*e* provided on the intermediate port sleeve 14. The bottom end of the tubular extension sleeve 13 of the tubular body 10 is provided with an internal O-ring 13*d* which slidably and sealably engages the external surface 80*a* of the intermediate valve 80.

Intermediate sleeve valve 80 is spring pressed into its closed position, as illustrated in FIG. 1D, by a spring 84 which operates between the upper end of the sliding sleeve valve 80 and a downwardly facing internal shoulder 13 b formed on the upper end of the body extension sleeve 13.

An actuator 90 is rigidly mounted on the bottom portion of the enlarged diameter intermediate portion 102 of the mandrel 100 to provide an operative engagement with the intermediate sliding sleeve valve 80. Actuator 90 comprises a hub portion 90*a* which is snugly fitted around the bottom end of the intermediate mandrel portion 102 and secured in such position by the upper end 103*d* of the lower rod portion 103 of the mandrel 100. The body portion 90*a* is provided with a plurality of peripherally spaced, radial spokes 90*b* which respectively project into the path of the bottom face of the intermediate sliding sleeve valve 80. Thus, any upward movement of the mandrel 100 relative to the tubular body 10 will produce an immediate upward displacement of the intermediate valve 80 and thus establish fluid communication between the intermediate ports 14*b* and the bypass fluid passage 12.

The operation of the aforedescribed structure will be readily apparent to those skilled in the art. In the normal operation of a bridge plug, the operator is accustomed to first engaging the pin 95 on the mandrel control head 104 (FIG. 2) with a conventional tubing or wire-line controlled J-slot running tool (not shown), so that the mandrel 100 may be readily moved from its inoperative position illustrated in FIGS. 1A–1E relative to the tubular body through the application of an upward or downward force to the mandrel control head 104. The operator is accustomed to removing bridge plugs by first imparting a downward motion to the mandrel 100 by the interconnected running tool. Such downward motion effects a downward displacement of the lowermost poppet valve 70 and establishes a fluid connection between the lowermost ports 16*b* and the bypass fluid passage 12, thus establishing a fluid bypass around the lower elastomeric sealing element 40', as shown in FIG. 2. This should then permit upward movement of the tubular body 10 to be accomplished without interference from the elastomeric sealing element 40' or the lower slips 20.

To insure that no fluid pressure differential exists across either of the elastomeric sealing elements 40 and 40', the subsequent upward movement of the mandrel 100 will bring the spokes 90*b* of the actuator 90 into abutting engagement with the bottom end of the intermediate valve 80 and move such valve upwardly, thus establishing fluid communication between the radial ports 14*b* and the bypass fluid passage 12. Concurrently, the upwardly facing shoulder 101*a* established at the juncture of the upper rod portion 101 and the larger diameter intermediate portion 102 of the mandrel 100, will be brought into engagement with the bottom surface of the sliding sleeve valve 60 and move such valve upwardly, thus establishing fluid communication between the port opening 47 in the cage 46 and the bypass fluid passage 12. Thus, a large diameter fluid bypass passage is established around both sealing elements 40 and 40' and maintained during all subsequent upward movement of mandrel 100, and it is therefore impossible for either of the slips 20 or 20' to be engaged with the wall 1*a* of the well conduit or casing 1. After a lost motion movement of the mandrel 10 sufficient to establish pressure-equalizing flow of fluid through the bypass passage 12, the upper surface 60*c* of the upper poppet valve 60 will engage the downwardly facing surface 49 provided on the cage 46 and effect an upward movement of the tubular body 10 to remove the entire structure from the well.

The simplicity of the described structure and its reliability in operation will be readily apparent to those skilled in the art. The reliability of a bridge plug has been substantially increased while, at the same time, the construction has been simplified and the overall strength of the apparatus, particularly of the control mandrel, has been significantly improved.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well tool adaptable for movement longitudinally in a subterranean well conduit, comprising: a tubular body; first and second normally retracted slip means disposed around said body; first and second expander means responsive to movement of said body, said expander means being relatively movable into engagement with said first and second slip means, respectively, to selectively expand only one of said first and second slip means against the well conduit, one of said first and second slip means when in expanded position resisting downward movement of said well tool within said conduit and the other of said first and second slip means when in expanded position resisting upward movement of said well tool within said conduit; elastomeric packing means on said body adjacent each said expander having a unidirectional sealing engagement with the conduit, whereby a downward fluid pressure differential on said elastomeric packing means shifts one of said expander means downwardly to expand said one slip means and an upward fluid pressure differential shifts the other said expander means. upwardly to expand said other slip means; a mandrel insertable in the bore of said tubular body and operatively engageable with said tubular body to retract the tool from the well, a bypass fluid passage defined between the exterior of said mandrel and the bore of said tubular body, said bypass fluid passage extending from a region above the upper one of said elastomeric packer means to a region below the lower one of said elastomeric packer means; an upper radial port in said tubular body communicating with the upper portion of said bypass passage; a lower radial port in said tubular body communicating with the lower portion of said bypass passage; a first valve mounted in the upper end of said bypass passage; first resilient means urging said first valve to a closed position between said upper radial port and said bypass passage; a second valve mounted on said tubular body adjacent said lower port; a second resilient means urging said second valve to a closed position relative to said second port; axially spaced abutment means on said mandrel respectively engagable with said first and second valves by limited movement of said mandrel relative to said tubular body, thereby opening a fluid bypass around both said elastomeric packing means; and means on said tubular body operatively engaged by further movement of said mandrel to remove said tool from the well conduit.

2. The apparatus of claim 1 further comprising a third radial port in said tubular body below said lower port; a third valve mounted on said mandrel between said bypass passage and said lower port, a third resilient means urging said third valve to a closed position relative to said third port; and abutment means on said mandrel engagable with said third valve to shift same to a port opening position by movement of said mandrel.

3. The apparatus of claim 1 wherein said operative engagement between said mandrel and said tubular body comprises a shoulder on said upper valve engagable with a shoulder on said tubular body after sufficient movement of said mandrel and upper valve to open said fluid bypass passage around both of said elasotmeric packing elements.

4. The apparatus of claim 1 wherein the axially spaced abutment means on said mandrel that engages said second valve comprises a hub fixedly secured to said mandrel in said bypass fluid passage at a position below said second valve; said hub having a plurality of angularly spaced, radial spokes traversing said bypass passage and axially abuttable with said second valve to move same by initial movement of said mandrel relative to said tubular body.

5. The apparatus of claim 4 further comprising a third radial port in said tubular body below said lower port; a third valve mounted on said mandrel between said bypass passage and said lower port, a third resilient means urging said third valve to a closed position relative to said third port; and abutment means on said mandrel engagable with said third valve to shift same to a port opening position by movement of said mandrel.

6. A well tool adaptable for movement longitudinally in a subterranean well conduit, comprising: a tubular body; first and second normally retracted slip means disposed around said body; first and second expander means responsive to movement of said body, said expander means being relatively movable into engagement of said first and second slip means, respectively, to selectively expand only one of said first and second slip means against the well conduit, one of said first and second slip means when in expanded position resisting downward movement of said well tool within said conduit and the other of said first and second slip means when in expanded position resisting upward movement of said well tool within said conduit; elastomeric packing means on said body adjacent each said expander having a unidirectional sealing engagement with the conduit, whereby a downward fluid pressure differential on said elastomeric packing means shifts one of said expander means downwardly to expand said one slip means and an upward fluid pressure differential shifts the other said expander means upwardly to expand said other slip means; a mandrel insertable in the bore of said tubular body and operatively engageable with said tubular body to retract the tool from the well, a bypass fluid passage defined between the exterior of said mandrel and the bore of said tubular body, said bypass fluid passage extending from a region above the upper one of said elastomeric packer means to a region below the lower one of said elastomeric packer means; an upper radial port in said tubular body communicating with the upper portion of said bypass passage; a lower radial port in said tubular body communicating with the lower portion of said bypass passage; a first poppet valve mounted in the upper end of said bypass passage; first resilient means urging said first poppet valve to a closed position between said upper radial port and said bypass passage; a sliding sleeve valve mounted on said tubular body adjacent said lower port; a second resilient means urging said sliding sleeve valve to a closed position relative to said lower port; axially spaced abutment means on said mandrel respectively engagable with said valves by limited upward movement of said mandrel relative to said tubular body, thereby opening a fluid bypass around both said elastomeric packing means; and means on said tubular body operatively engaged by further upward movement of said mandrel to remove said tool from the well conduit.

7. The apparatus of claim 6 further comprising a third radial port in said tubular body below said lower port; a second poppet valve mounted on said mandrel between said bypass passage and said lower port, a third resilient means urging said second poppet valve to a closed position relative to said third port; and downwardly facing abutment means on said mandrel engagable with said second poppet valve to shift same to a port opening position by downward movement of said mandrel.

8. The apparatus of claim 6 wherein said operative engagement between said mandrel and said tubular body comprises an upwardly facing shoulder on said first poppet valve engagable with a downwardly facing shoulder on said tubular body after sufficient upward movement of said mandrel and first poppet valve to open said fluid bypass passage around both of said elasotmeric packing elements.

9. The apparatus of claim 6 wherein the axially spaced abutment means on said mandrel that engages said sliding sleeve valve comprises a hub fixedly secured to said mandrel in said bypass fluid passage at a position below said sliding sleeve valve; said hub having a plurality of angularly spaced, radial spokes traversing said bypass passage and axially abuttable with said sliding sleeve valve to move same upwardly by initial upward movement of said mandrel relative to said tubular body.

10. The apparatus of claim 9 further comprising a third radial port in said tubular body below said lower port; a second poppet valve mounted on said mandrel between said bypass passage and said lower port, a third resilient means urging said second poppet valve to a closed position relative to said third port; and downwardly facing abutment means on said mandrel engagable with said second poppet valve to shift same to a port opening position by downward movement of said mandrel.

* * * * *